US006618902B2

(12) United States Patent
Wu

(10) Patent No.: US 6,618,902 B2
(45) Date of Patent: Sep. 16, 2003

(54) TUBULAR SPRING HINGE ASSEMBLY

(76) Inventor: Chien-Chen Wu, P.O. Box 55-124, Taichung (TW)

( * ) Notice: Subject to any disclaimer, the term of this patent is extended or adjusted under 35 U.S.C. 154(b) by 0 days.

(21) Appl. No.: 10/159,041

(22) Filed: Jun. 3, 2002

(65) Prior Publication Data

US 2003/0051313 A1 Mar. 20, 2003

(30) Foreign Application Priority Data

Sep. 14, 2001 (TW) ..... 90216084 U

(51) Int. Cl.[7] ..... E05F 1/08

(52) U.S. Cl. ..... 16/298; 16/273; 16/50; 16/283; 16/286; 16/299; 16/366

(58) Field of Search ..... 16/298, 299, 273, 16/50, 282, 283, 286, 287, 366

(56) References Cited

U.S. PATENT DOCUMENTS 3,921,225 A * 11/1975 Suska ..... 16/273
3,999,246 A * 12/1976 Suska ..... 16/273
4,351,085 A * 9/1982 Suska ..... 16/273
4,475,266 A * 10/1984 Suska ..... 16/273
4,675,940 A * 6/1987 Brockhaus ..... 16/273
4,829,628 A * 5/1989 Vuksic ..... 16/54
5,463,795 A * 11/1995 Carlson et al. ..... 16/273
6,256,839 B1 * 7/2001 Wu ..... 16/366

FOREIGN PATENT DOCUMENTS

BE 1013455 A6 * 2/2002
DE 2554066 A * 6/1977
DE 19912335 A1 * 3/1999
JP 08-193616 A * 7/1996
SU 1782846 A1 * 12/1992

* cited by examiner

*Primary Examiner*—Chuck Y. Mah

(57) ABSTRACT

A tubular spring hinge assembly includes a connecting tube for connecting two tubes, and two separation tubes mounted between the connecting tube and each of the two tubes. Each of the two separation tubes is made of a wear-resistant plastic, thereby eliminating noise due to friction when the two tubes are rotated relatively by the door plate.

19 Claims, 11 Drawing Sheets

TUBULAR SPRING HINGE ASSEMBLY

BACKGROUND OF THE INVENTION

1. Field of the Invention

The present invention relates to a tubular spring hinge assembly, and more particularly to a tubular spring hinge assembly that may efficiently eliminate noise due to friction when the two tubes are rotated relatively by the door plate.

2. Description of the Related Art

A conventional spring hinge in accordance with the prior art shown in FIGS. 1 and 2 comprises an upper tube 1, a lower tube 2, a torsion spring 3, a central shaft 4, and two tension adjusting seats 5.

The upper tube 1 has an insertion section 101 pivotally inserted into the lower tube 2. The upper tube 1 has a side provided with an ear plate 102, and the lower tube 2 has a side provided with an ear plate 202. The torsion spring 3 is mounted in the upper tube 1 and the lower tube 2. Each of the two tension adjusting seats 5 is mounted on the top of the upper tube 1 and the bottom of the lower tube 2. The central shaft 4 is mounted in the torsion spring 3, and has two ends each passed through each of the two tension adjusting seats 5 and each screwed with a cover 401. Each of the two tension adjusting seats 5 is formed with a positioning hole 501 for mounting a metallic protection tube 502. Each of the two ends of the torsion spring 3 is inserted into the metallic protection tube 502. Each of the two tension adjusting seats 5 has a periphery formed with multiple adjusting holes 503 for insertion of a first end of a pin 504 whose second end is rested on the side face of each of the two ear plates 102 and 202. Each of the two tension adjusting seats 5 may be rotated by each of the two ear plates 102 and 202, to twist the torsion spring 3 which may store the energy, so that the door may be restored automatically after being opened.

After the conventional spring hinge is mounted between the door plate and the door frame, the upper tube 1 and the lower tube 2 may be rotated relatively when the door plate is opened or closed, so that the insertion section 101 of the upper tube 1 is rubbed with the lower tube 2, thereby producing noise.

SUMMARY OF THE INVENTION

The present invention has arisen to mitigate and/or obviate the disadvantage of the conventional spring hinge.

The primary objective of the present invention is to provide a tubular spring hinge assembly including a connecting tube for connecting two tubes, and two separation tubes mounted between the connecting tube and each of the two tubes. Each of the two separation tubes is made of a wear-resistant plastic, thereby efficiently eliminating noise due to friction when the two tubes are rotated relatively by the door plate.

Further benefits and advantages of the present invention will become apparent after a careful reading of the detailed description with appropriate reference to the accompanying drawings.

DETAILED DESCRIPTION OF THE INVENTION

Figure 1:
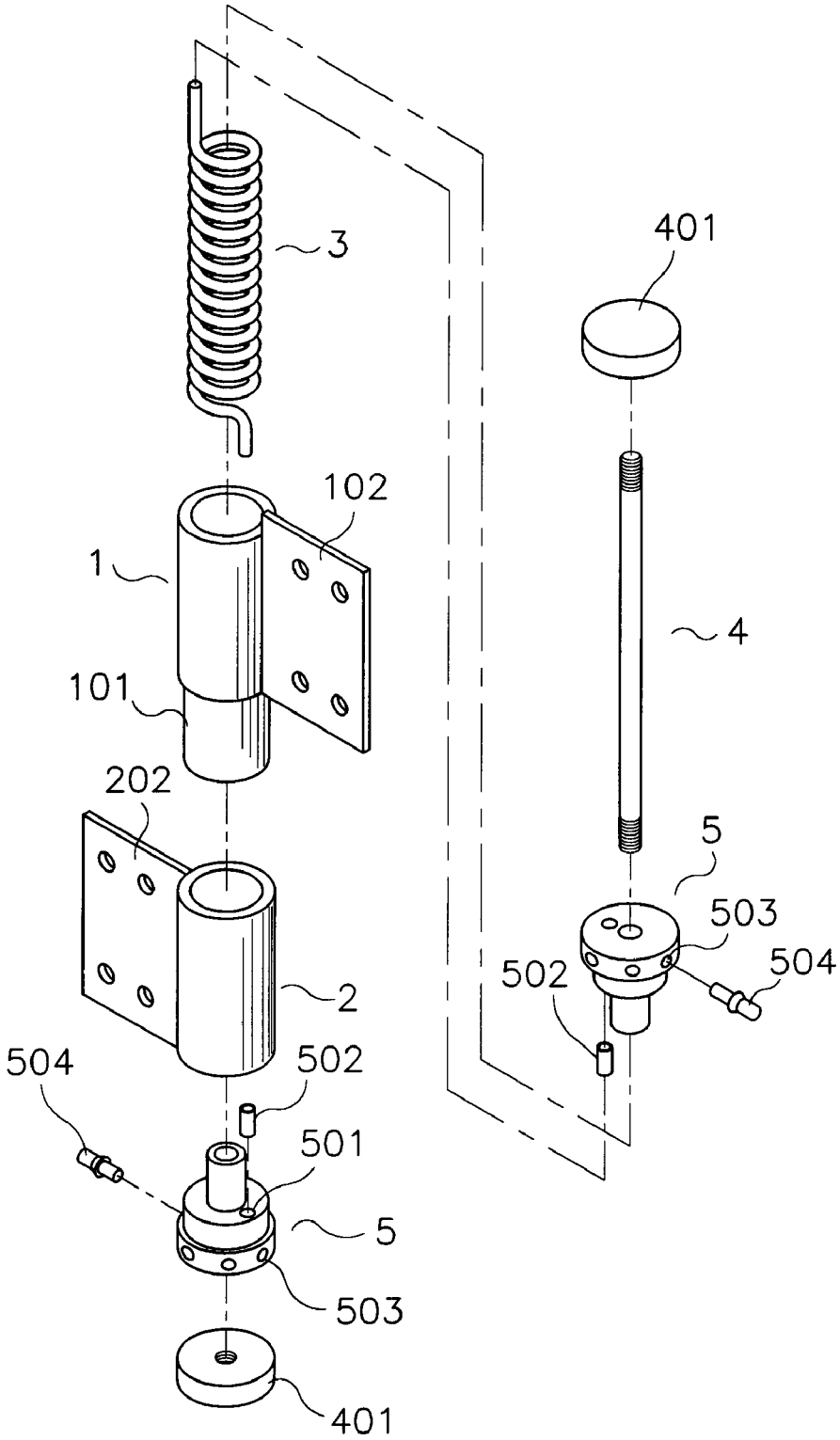
FIG. 1 PRIOR ART
FIG. 1 is an exploded perspective view of a conventional spring hinge in accordance with the prior art.
Figure 2:
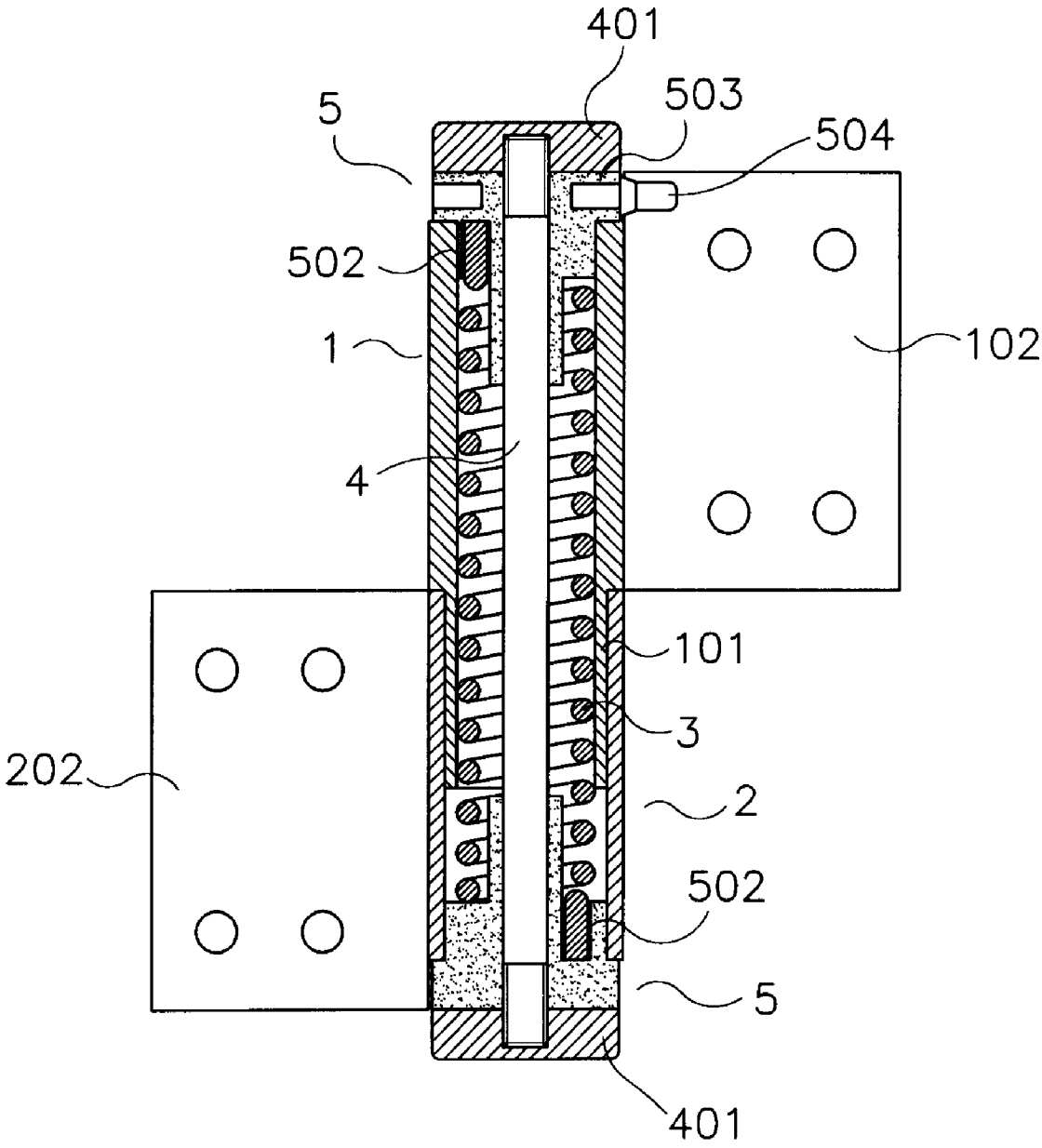
FIG. 2 PRIOR ART
FIG. 2 is a side plan cross-sectional assembly view of the conventional spring hinge as shown in FIG. 1.
Figure 3:
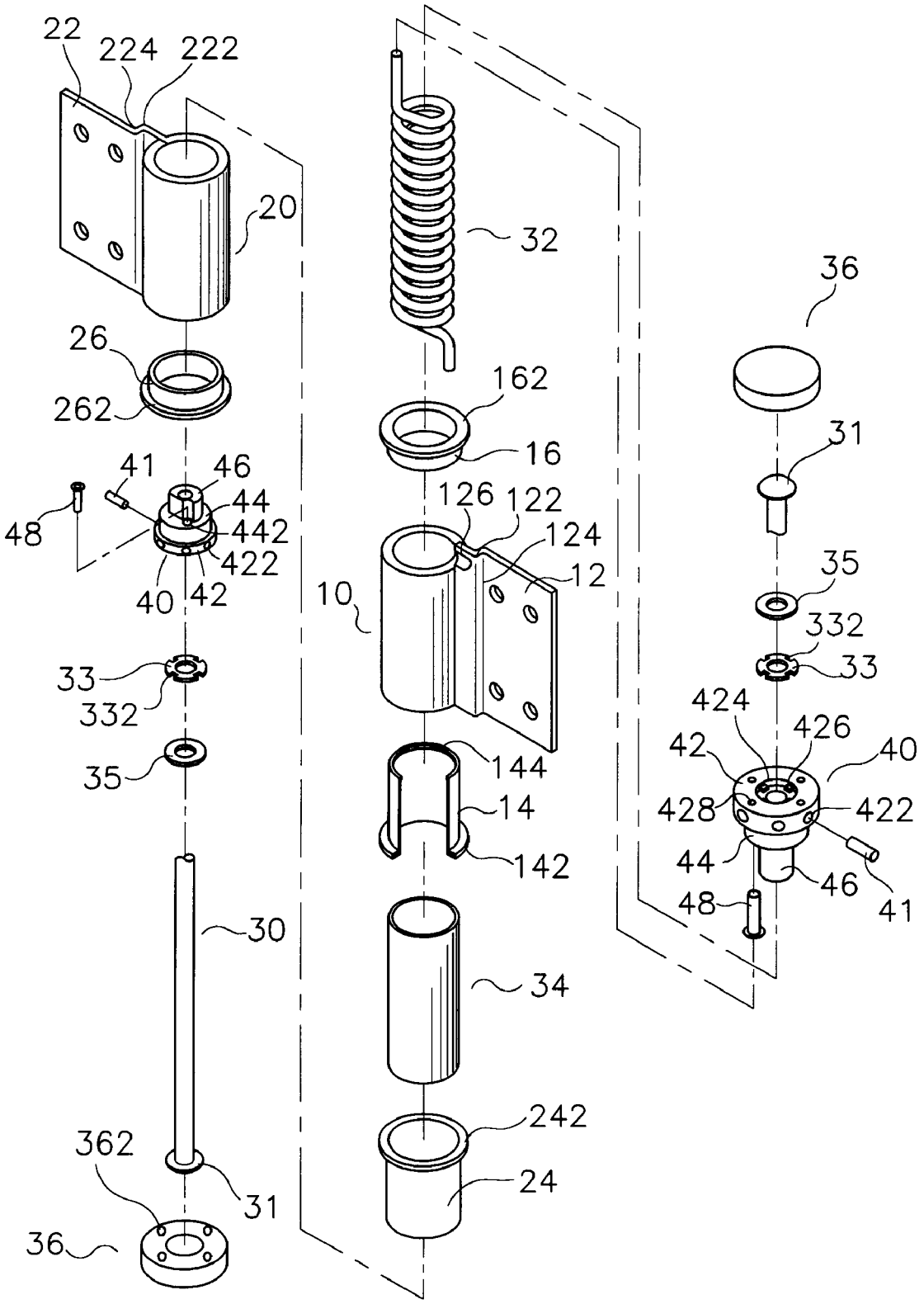
FIG. 3 is an exploded perspective view of a tubular spring hinge assembly in accordance with a first embodiment of the present invention.
Figure 4:
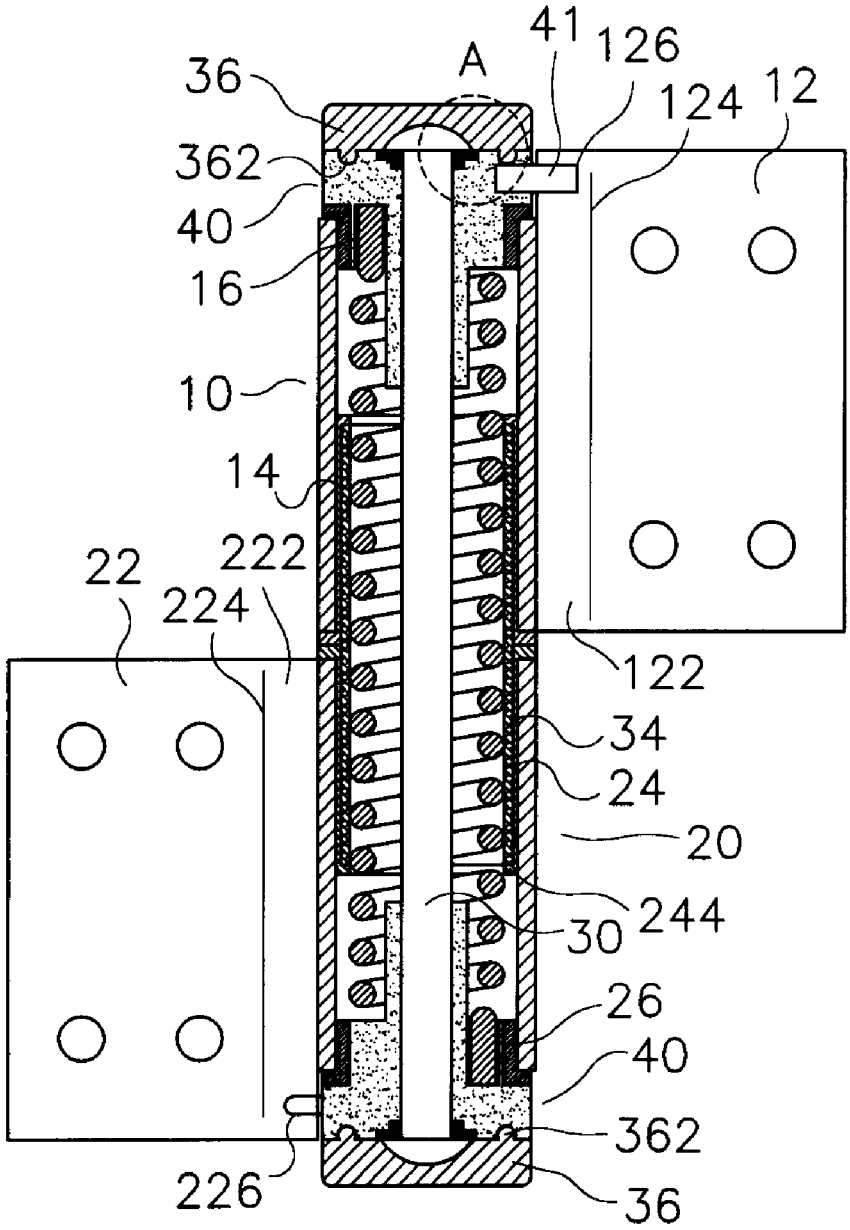
FIG. 4 is a side plan cross-sectional assembly view of the tubular spring hinge assembly as shown in FIG. 3.

Referring to the drawings and initially to FIGS. 3 and 4, a tubular spring hinge assembly in accordance with a first embodiment of the present invention comprises a first outer tube 10, a second outer tube 20, a central shaft 30, a torsion spring 32, and two regulators 40.

The first outer tube 10 has a side provided with a leaf 12, and the second outer tube 20 has a side provided with a leaf 22, so that the first outer tube 10 and the second outer tube 20 may be locked on the door plate and the door frame respectively. The first outer tube 10 is pivotally mounted on the second outer tube 20. The torsion spring 32 is mounted in the first outer tube 10 and the second outer tube 20. Each of the two regulators 40 is mounted on an outer end of the first outer tube 10 and the second outer tube 20 respectively. The central shaft 30 is mounted in the torsion spring 32, and has two ends each extended through each of the two regulators 40.

Each of the two regulators 40 is an axial integrally formed stepped body including a base portion 42, a positioning portion 44, and a separation portion 46. The base portion 42 has an outer diameter greater than that of the positioning portion 44, and the positioning portion 44 has an outer diameter greater than that of the separation portion 46. In addition, the positioning portion 44 is located between the base portion 42 and the separation portion 46. The separation portion 46 is extended into each of two ends of the torsion spring 32, for separating the torsion spring 32 from the central shaft 30, thereby preventing the torsion spring 32 from rubbing the central shaft 30. The positioning portion 44 is formed with a positioning hole 442 for mounting a metallic protection tube 48, and each of the two ends of the torsion spring 32 is inserted into the metallic protection tube 48. The base portion 42 of each of the two regulators 40 has a periphery formed with multiple adjusting holes 422 for insertion of a first end of a pin member 41 whose second end is rested on the side face of each of the leaf 12 and the leaf 22. Each of the two regulators 40 may be rotated by each of the leaf 12 and the leaf 22, to twist the torsion spring 32 which may store the torsion energy, so that the door plate may be restored automatically after being opened.

A connecting tube 34 is mounted between the first outer tube 10 and the second outer tube 20 for connecting the first outer tube 10 and the second outer tube 20.

A first separation tube 14 is mounted in a first end of the first outer tube 10, and a second separation tube 24 is mounted in a first end of the second outer tube 20. Each of the first separation tube 14 and the second separation tube 24 is made of a wear-resistant plastic, such as PVC. The first separation tube 14 has a first end having an outer wall formed with an annular separation flange 142 rested on an end face of the first end of the first outer tube 10, and the second separation tube 24 has a first end having an outer wall formed with an annular separation flange 242 rested on an end face of the first end of the second outer tube 20, so as to separate the first outer tube 10 from the second outer tube 20, thereby preventing the first outer tube 10 and the second outer tube 20 from rubbing and producing noise. The first separation tube 14 has a second end having an inner wall formed with an annular retaining portion 144, and the second separation tube 24 has a second end having an inner wall formed with an annular retaining portion 244.

The connecting tube 34 is mounted in the first separation tube 14 and the second separation tube 24, and has two ends each retained by the annular retaining portion 144 of the first separation tube 14 and the annular retaining portion 244 of the second separation tube 24, so that the first outer tube 10 and the second outer tube 20 may be co-axially rotated relatively.

In addition, the first separation tube 14 and the second separation tube 24 may separate the connecting tube 34 from the first outer tube 10 an the second outer tube 20, thereby preventing the connecting tube 34 from contacting and rubbing the first outer tube 10 and the second outer tube 20, so as to eliminate noise.

Further, a first separation ring 16 made of a wear-resistant plastic is mounted in a second end of the first outer tube 10, and a second separation ring 26 made of a wear-resistant plastic is mounted in a second end of the second outer tube 20. The positioning portion 44 of each of the two regulators 40 is mounted in the first separation ring 16 and the second separation ring 26. The first separation ring 16 has one end having an outer wall formed with an annular separation flange 162 mounted between the base portion 42 of one of the two regulators 40 and the first outer tube 10, and the second separation ring 26 has one end having an outer wall formed with an annular separation flange 262 mounted between the base portion 42 of the other of the two regulators 40 and the second outer tube 20, thereby preventing each of the two regulators 40 from contacting and rubbing the first outer tube 10 and the second outer tube 20, so as to eliminate noise and to increase the lifetime of each of the two regulators 40.

Figure 4A:
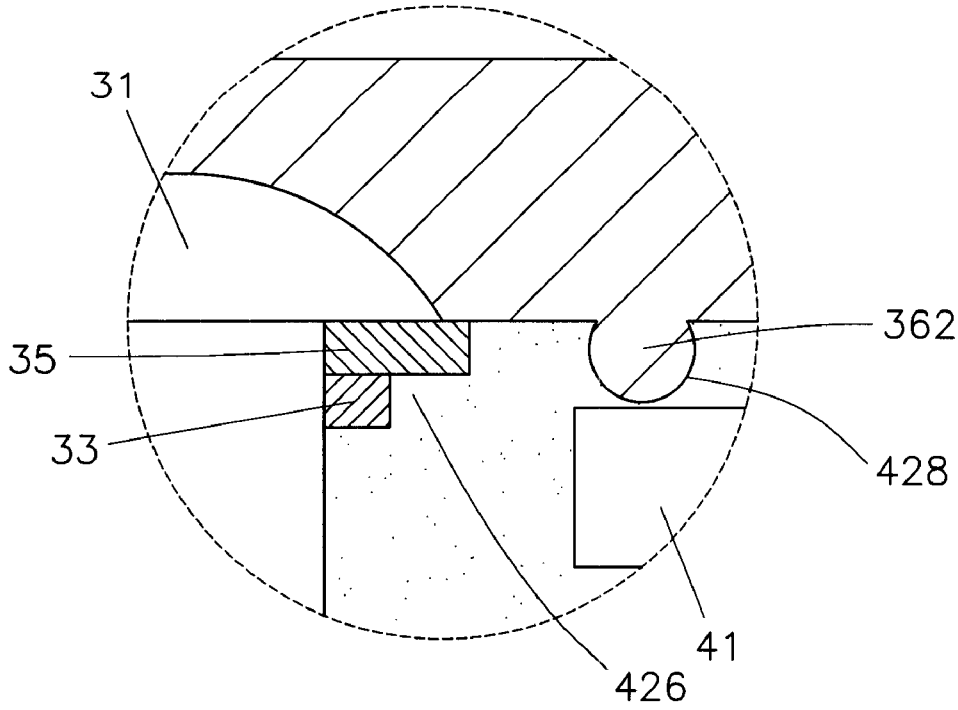
FIG. 4A is a partially cut-away enlarged view of the tubular spring hinge assembly as shown in FIG. 4.

The central shaft 30 has two ends each formed with an enlarged head 31 which is provided with a first washer 33 and a second washer 35, wherein the second washer 35 is located between the first washer 33 and the enlarged head 31. The base portion 42 of each of the two regulators 40 is formed with a recess 424 for receiving the first washer 33 and the second washer 35 as shown in FIG. 4A. The first washer 33 has a periphery formed with multiple insertion openings 332. The recess 424 is provided with multiple protruding insertion teeth 426 inserted into the multiple insertion openings 332, thereby preventing the shaft hole of each of the two regulators 40 from being enlarged by the central shaft 30. The second washer 35 may be used to support the enlarged head 31 during the punching process of the enlarged head 31, thereby preventing the enlarged head 31 from jamming the regulator 40, so as to increase the lifetime of the regulator 40.

A cover 36 is mounted on each of the two regulators 40 for covering the enlarged head 31 of the central shaft 30. The base portion 42 of each of the two regulators 40 is formed with multiple insertion recesses 428. The cover 36 is provided with multiple snapping bosses 362 each inserted and snapped into one of the multiple insertion recesses 428 of the base portion 42 of each of the two regulators 40, so that the cover 36 may be secured on each of the two regulators 40.

The leaf 12 of the first outer tube 10 is provided with a shoulder 122 which is formed with an abutting edge 124, and the leaf 22 of the second outer tube 20 is provided with a shoulder 222 which is formed with an abutting edge 224, so that the door plate or the door frame may be rested on the abutting edge 124 of the shoulder 122 of the leaf 12 of the first outer tube 10 or the abutting edge 224 of the shoulder 222 of the leaf 22 of the second outer tube 20, thereby facilitating assembly of the first outer tube 10 an the second outer tube 20. In addition, the shoulder 122 of the leaf 12 of the first outer tube 10 is formed with a recessed resting portion 126 for positioning the pin member 41, and the shoulder 222 of the leaf 22 of the second outer tube 20 is formed with recessed resting portion 226 for positioning the pin member 41.

In assembly, after the central shaft 30 is in turn extended through the torsion spring 32, each of the two regulators 40, the first washers 33 and the second washers 35, each of the two ends of the central shaft 30 is formed with the enlarged head 31 by a punching process, thereby positioning the parts. When the tubular spring hinge assembly in accordance with the first embodiment of the present invention is mounted on the door, the door plate and the door frame of the door may be rested on the abutting edge 124 of the first outer tube 10 and the abutting edge 224 of the second outer tube 20, thereby enhancing convenience of assembly. In addition, the connecting tube 34 is used for connecting the first outer tube 10 and the second outer tube 20, so that the first outer tube 10 and the second outer tube 20 may be made to have the same shape, thereby decreasing cost of fabrication.

When the door is opened or closed, the leaf 12 of the first outer tube 10 and the leaf 22 of the second outer tube 20 may drive the first outer tube 10 and the second outer tube 20 to rotate relatively. The first separation tube 14 and the second separation tube 24 may separate the connecting tube 34 from the first outer tube 10 an the second outer tube 20, thereby preventing the connecting tube 34 from contacting and rubbing the first outer tube 10 and the second outer tube 20, so as to eliminate noise.

Figure 5:
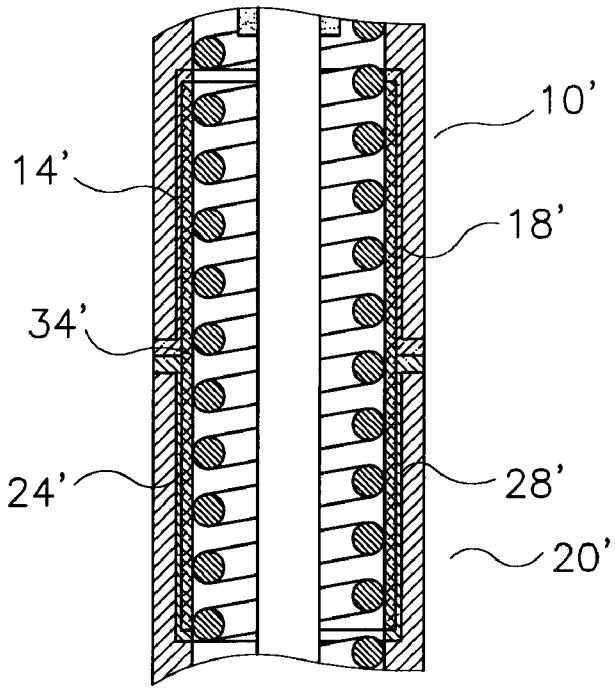
FIG. 5 is a partially cut-away side plan cross-sectional assembly view of a tubular spring hinge assembly in accordance with a second embodiment of the present invention.

Referring to FIG. 5, a tubular spring hinge assembly in accordance with a second embodiment of the present invention is shown. The structure of the tubular spring hinge assembly in accordance with the second embodiment of the present invention is substantially the same as that of the tubular spring hinge assembly in accordance with the first embodiment of the present invention, and the difference is described as follows.

The inner wall of the first outer tube 10' is formed with a mounting section 18' for mounting the first separation tube 14', and the inner wall of the second outer tube 20' is formed with a mounting section 28' for mounting the second separation tube 24', thereby preventing the first outer tube 10' and the second outer tube 20' from deviating relatively due to effect of the gravity of the door plate. In addition, a connecting tube 34' is mounted in the first separation tube 14' and the second separation tube 24'.

Figure 6:
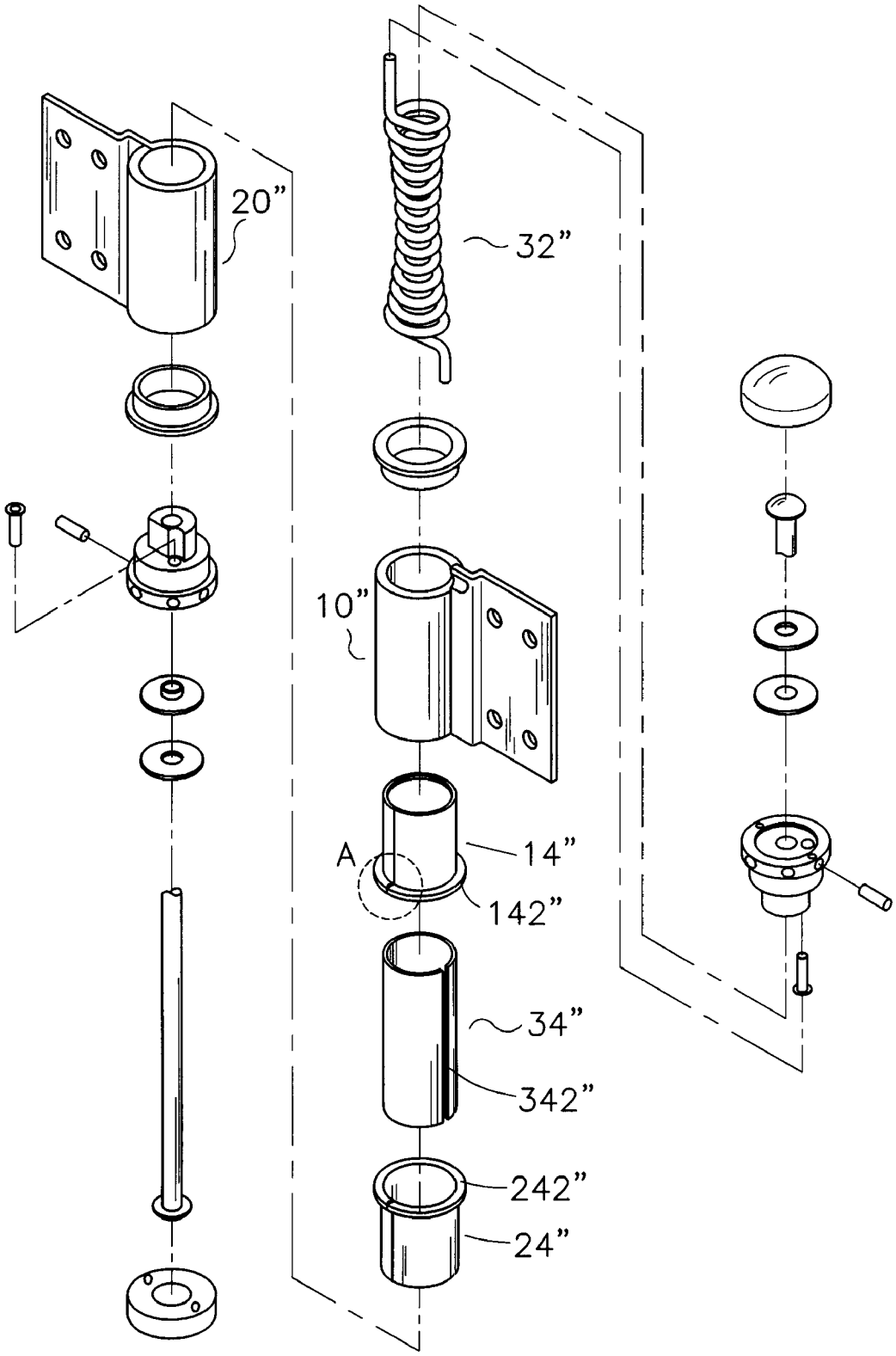
FIG. 6 is an exploded perspective view of a tubular spring hinge assembly in accordance with a third embodiment of the present invention.
Figure 7:
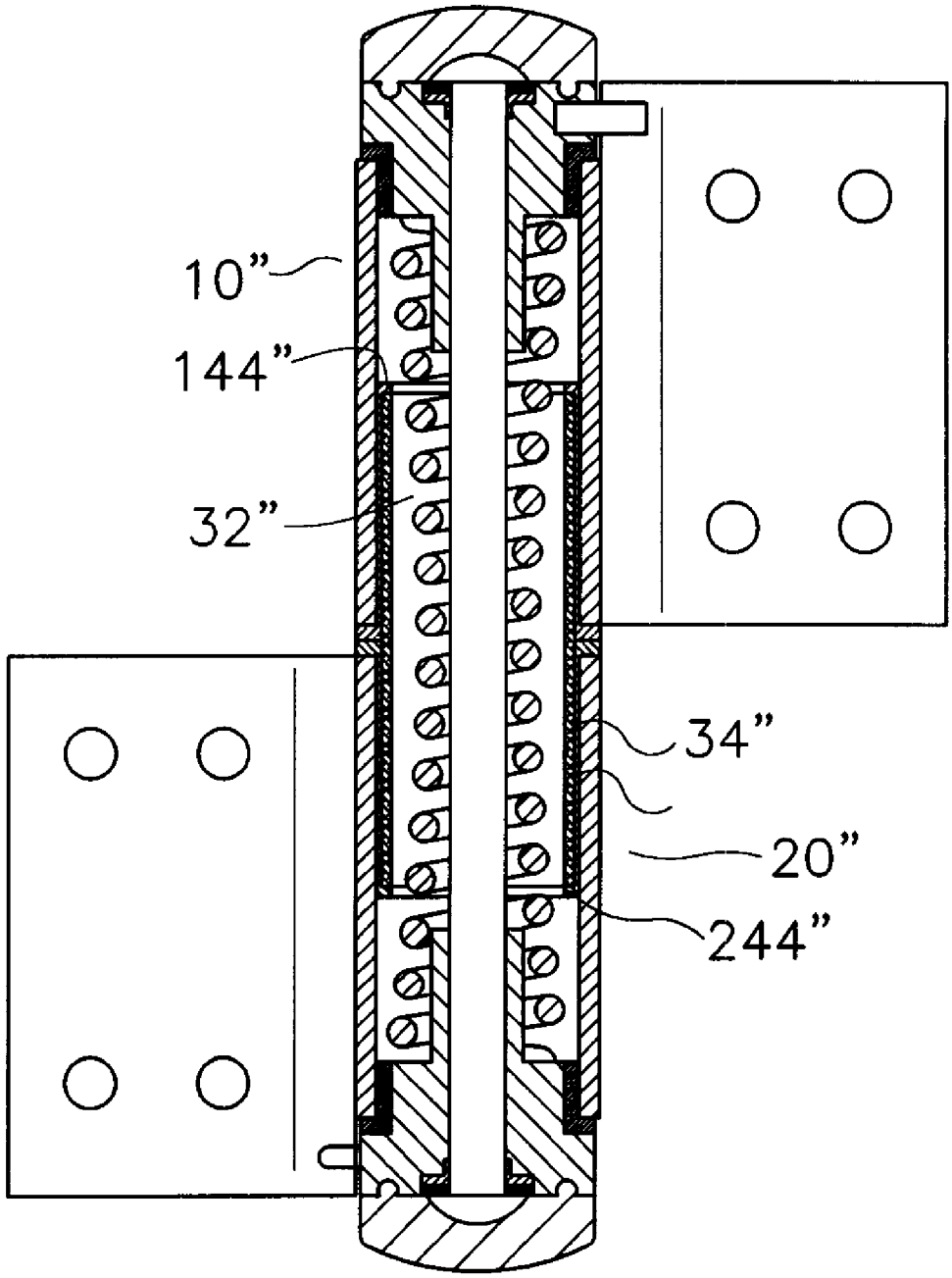
FIG. 7 is a side plan cross-sectional assembly view of the tubular spring hinge assembly as shown in FIG. 6.

Referring to FIGS. 6 and 7, a tubular spring hinge assembly in accordance with a third embodiment of the present invention is shown. The structure of the tubular spring hinge assembly in accordance with the third embodiment of the present invention is substantially the same as that of the tubular spring hinge assembly in accordance with the first embodiment of the present invention, and the difference is described as follows.

The torsion spring 32" has a horn shape, and has an outer diameter gradually reduced from two ends toward a mediate portion thereof. The connecting tube 34" is mounted on the mediate portion of the torsion spring 32", and is mounted in the first separation tube 14" and the second separation tube 24". The first separation tube 14" is mounted in the first outer tube 10", and the second separation tube 24" is mounted in the second outer tube 20". The inner diameter of the connecting tube 34" is smaller than the maximum outer diameter of the torsion spring 32". The wall of the connecting tube 34" is axially formed with a slit 342", so that the connecting tube 34" may be mounted on the mediate portion of the torsion spring 32" by the slit 342".

The first separation tube 14" has a first end having an outer wall formed with an annular separation flange 142" rested on an end face of the first end of the first outer tube 10", and the second separation tube 24" has a first end having an outer wall formed with an annular separation flange 242" rested on an end face of the first end of the second outer tube 20", so as to separate the first outer tube 10" from the second outer tube 20", thereby preventing the first outer tube 10" and the second outer tube 20" from rubbing and producing noise. The first separation tube 14" has a second end having an inner wall formed with an annular retaining portion 144", and the second separation tube 24" has a second end having an inner wall formed with an annular retaining portion 244".

The connecting tube 34" is mounted in the first separation tube 14" and the second separation tube 24", and has two ends each retained by the annular retaining portion 144" of the first separation tube 14" and the annular retaining portion 244" of the second separation tube 24", so that the first outer tube 10" and the second outer tube 20" may be co-axially rotated relatively.

In addition, the first separation tube 14" and the second separation tube 24" may separate the connecting tube 34" from the first outer tube 10" an the second outer tube 20", thereby preventing the connecting tube 34" from contacting and rubbing the first outer tube 10" and the second outer tube 20", so as to eliminate noise.

Figure 6A:
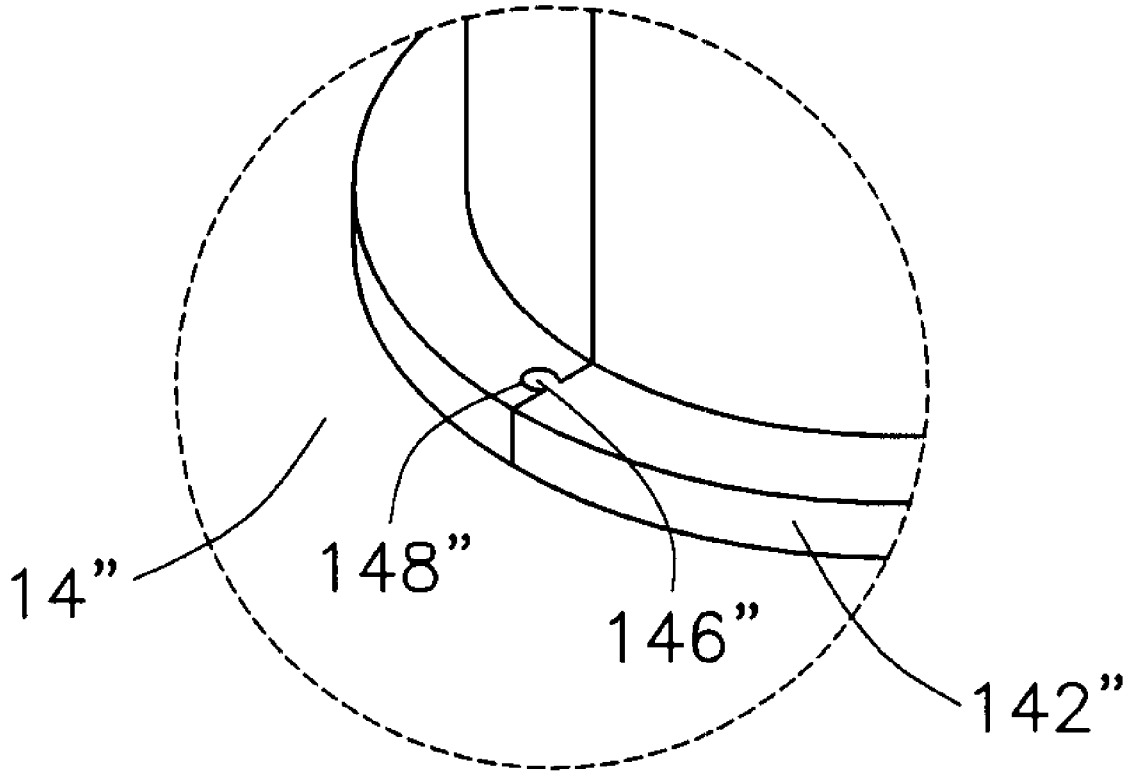
FIG. 6A is a partially cut-away enlarged view of the tubular spring hinge assembly as shown in FIG. 6.

As shown in FIGS. 6 and 6A, each of the first separation tube 14" and the second separation tube 24" has a substantially C-shaped cross-section, and each of the annular separation flange 142" and the annular separation flange 242" has a first end formed with a cavity 148", and a second end provided with a snap portion 146" inserted into the cavity 148", thereby snapping the first separation tube 14" and the second separation tube 24".

In assembly, the connecting tube 34" may be mounted on the mediate portion of the torsion spring 32" by opening and closing the slit 342". The inner diameter of the connecting tube 34" is smaller than the maximum outer diameter of the torsion spring 32", so that the connecting tube 34" may be retained on the mediate portion of the torsion spring 32" without axial displacement. Then, the connecting tube 34" and the torsion spring 32" may be inserted into the first separation tube 14" and the second separation tube 24". Then, the snap portion 146" may be snapped and inserted into the cavity 148", thereby snapping the first separation tube 14" and the second separation tube 24", so that the connecting tube 34" and the mediate portion of the torsion spring 32" may be positioned in the first separation tube 14" and the second separation tube 24".

Figure 8:
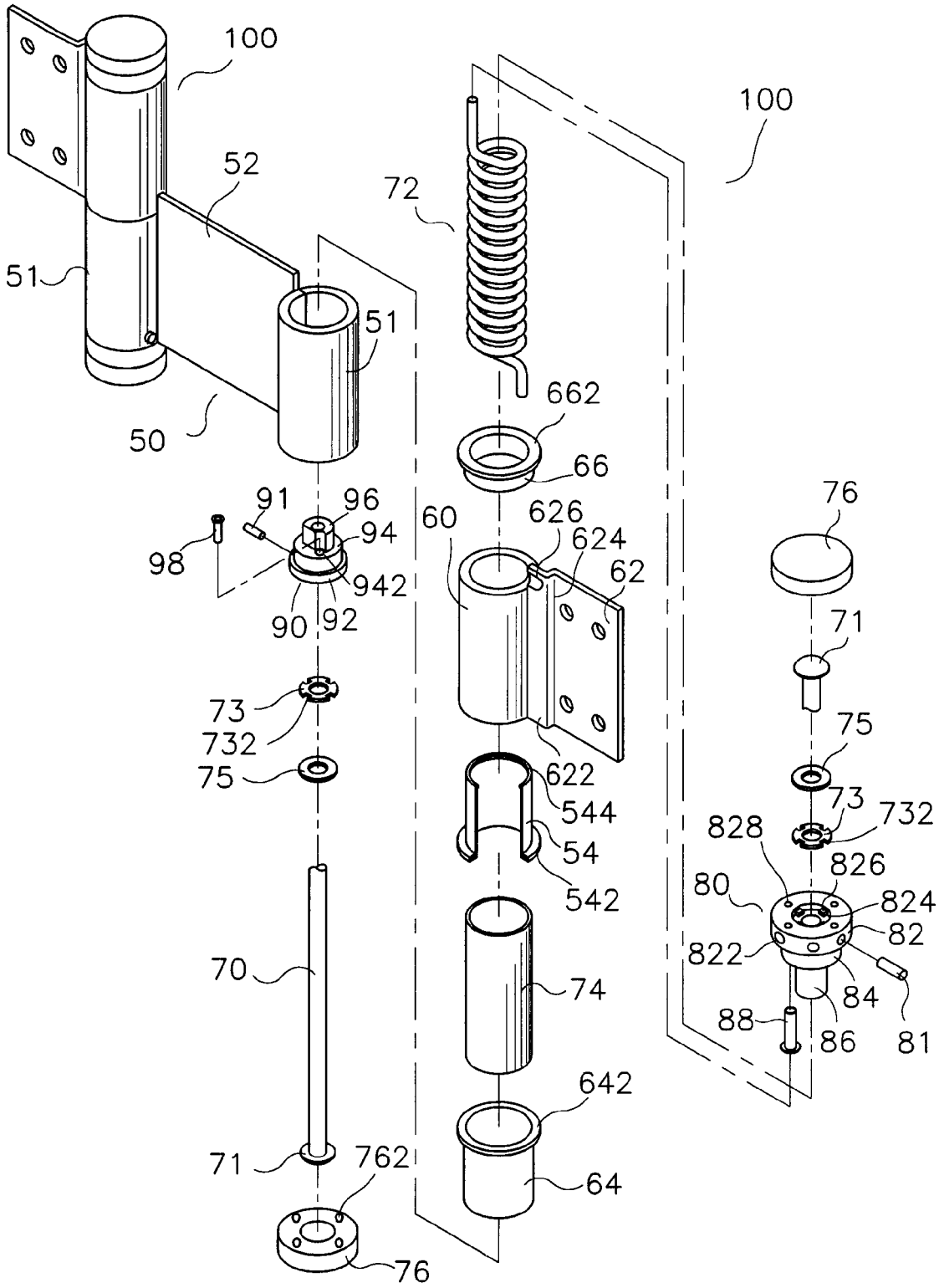
FIG. 8 is an exploded perspective view of a tubular spring hinge assembly in accordance with a fourth embodiment of the present invention.
Figure 9:
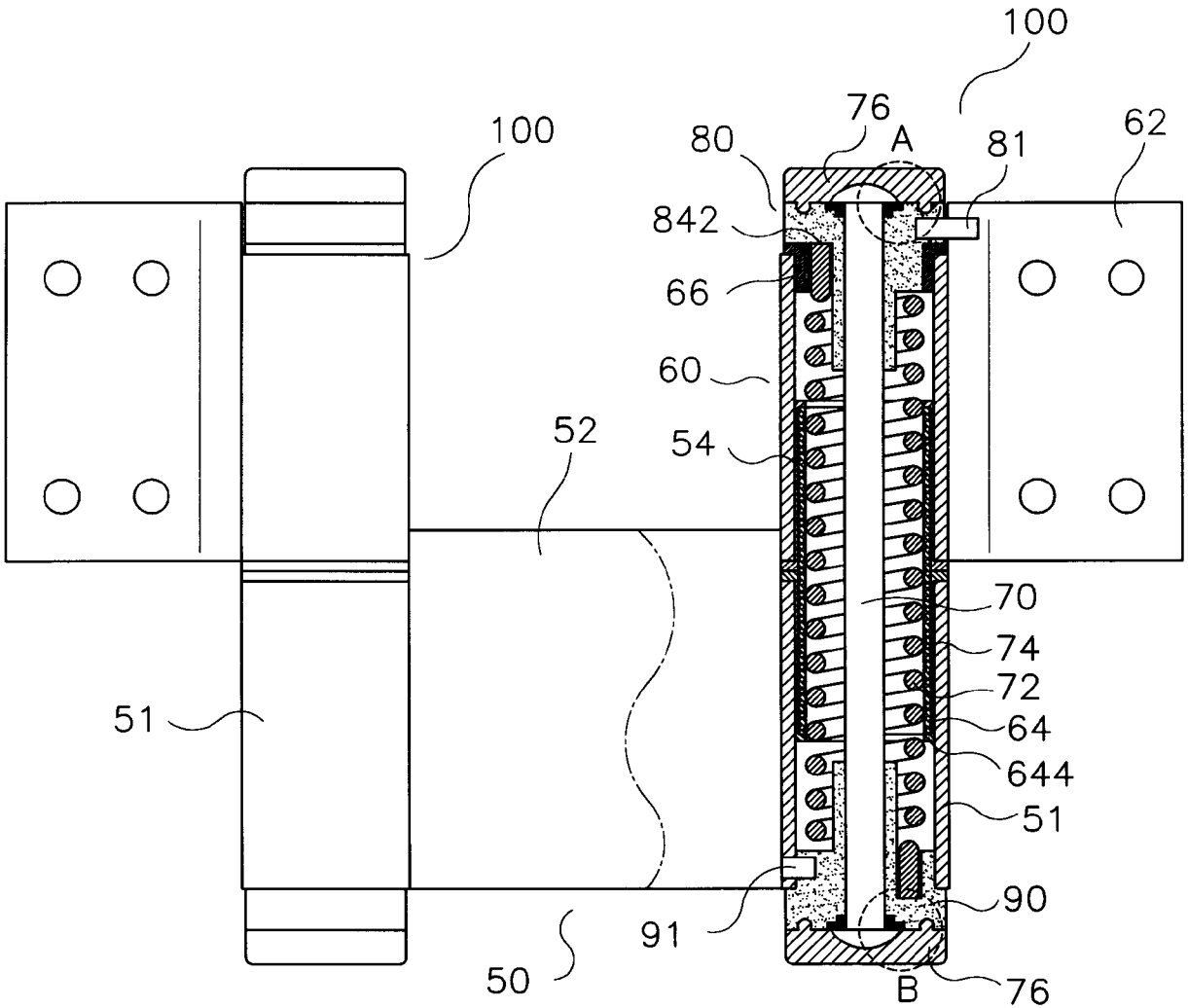
FIG. 9 is a side plan cross-sectional assembly view of the tubular spring hinge assembly as shown in FIG. 8.

Referring to FIGS. 8 and 9, a two-shaft type spring hinge assembly in accordance with a fourth embodiment of the present invention comprises a base 50, and a pair of pivot structures 100.

The base 50 includes two main tubes 51, and a connecting plate 52 integrally mounted between the two main tubes 51. Each of the pivot structures 100 is mounted on one of the two main tubes 51, and includes an outer tube 60, a central shaft 70, a torsion spring 72, a regulator 80, and a positioner 90. The outer tube 60 has a side provided with a leaf 62, so that the outer tube 60 may be locked on the door plate or the door frame. The outer tube 60 is pivotally mounted on one end of the main tube 51. The positioner 90 is mounted on the other end of the main tube 51, and includes a pin 91 rested on the main tube 51. The torsion spring 72 is mounted in the outer tube 60 and the main tube 51. The regulator 80 is mounted on an outer end of the outer tube 60. The central shaft 70 is mounted in the torsion spring 72, and has two ends each extended through the regulator 80 and the positioner 90.

The regulator 80 is an axial integrally formed stepped body including a base portion 82, a positioning portion 84, and a separation portion 86. The base portion 82 has an outer diameter greater than that of the positioning portion 84, and the positioning portion 84 has an outer diameter greater than that of the separation portion 86. In addition, the positioning portion 84 is located between the base portion 82 and the separation portion 86. The separation portion 86 is extended into one end of the torsion spring 72, for separating the torsion spring 72 from the central shaft 70, thereby preventing the torsion spring 72 from rubbing the central shaft 70. The positioning portion 84 is formed with a positioning hole 842 for mounting a metallic protection tube 88 for insertion of one end of the torsion spring 72. The base portion 82 of the regulator 80 has a periphery formed with multiple adjusting holes 822 for insertion of a first end of a pin member 81 whose second end is rested on the side face of the leaf 62 of the outer tube 60. The regulator 80 may be rotated by the leaf 62 of the outer tube 60 to twist the torsion spring 72 which may store the torsion energy, so that the door plate may be restored automatically after being opened.

The positioner 90 is an axial integrally formed stepped body including a base portion 92, a positioning portion 94, and a separation portion 96. The base portion 92 has an outer diameter greater than that of the positioning portion 94, and the positioning portion 94 has an outer diameter greater than that of the separation portion 96. In addition, the positioning portion 94 is located between the base portion 92 and the separation portion 96. The separation portion 96 is extended into the other end of the torsion spring 72, for separating the torsion spring 72 from the central shaft 70, thereby preventing the torsion spring 72 from rubbing the central shaft 70. The positioning portion 94 is formed with a positioning hole 942 for mounting a metallic protection tube 98 for insertion of the other end of the torsion spring 72.

A first separation tube 54 is mounted in a first end of the outer tube 60, and a second separation tube 64 is mounted in a first end of the main tube 51. Each of the first separation tube 54 and the second separation tube 64 is made of a wear-resistant plastic, such as PVC. The first separation tube 54 has a first end having an outer wall formed with an annular separation flange 542 rested on an end face of the first end of the outer tube 60, and the second separation tube 64 has a first end having an outer wall formed with an annular separation flange 642 rested on an end face of the first end of the main tube 51, so as to separate the outer tube 60 from the main tube 51, thereby preventing the outer tube 60 and the main tube 51 from rubbing and producing noise. The first separation tube 54 has a second end having an inner wall formed with an annular retaining portion 544, and the second separation tube 64 has a second end having an inner wall formed with an annular retaining portion 644.

A connecting tube 74 is mounted in the first separation tube 54 and the second separation tube 64, and has two ends each retained by the annular retaining portion 544 of the first separation tube 54 and the annular retaining portion 644 of the second separation tube 64, so that the outer tube 60 may be pivotally mounted on the main tube 51. In addition, the first separation tube 54 and the second separation tube 64 may separate the connecting tube 74 from the outer tube 60 and the main tube 51, thereby preventing the connecting tube 74 from contacting and rubbing the outer tube 60 and the main tube 51, so as to eliminate noise.

Further, a separation ring 66 made of a wear-resistant plastic is mounted in a second end of the outer tube 60. The positioning portion 84 of the regulator 80 is mounted in the separation ring 66. The separation ring 66 has one end having an outer wall formed with an annular separation flange 662 mounted between the base portion 82 of the regulator 80 and the outer tube 60, thereby preventing the regulator 80 from contacting and rubbing the outer tube 60, so as to eliminate noise and to increase the lifetime of the regulator 80.

The central shaft 70 has two ends each formed with an enlarged head 71 which is provided with a first washer 73 and a second washer 75, wherein the second washer 75 is located between the first washer 73 and the enlarged head 71.

Figure 9A:
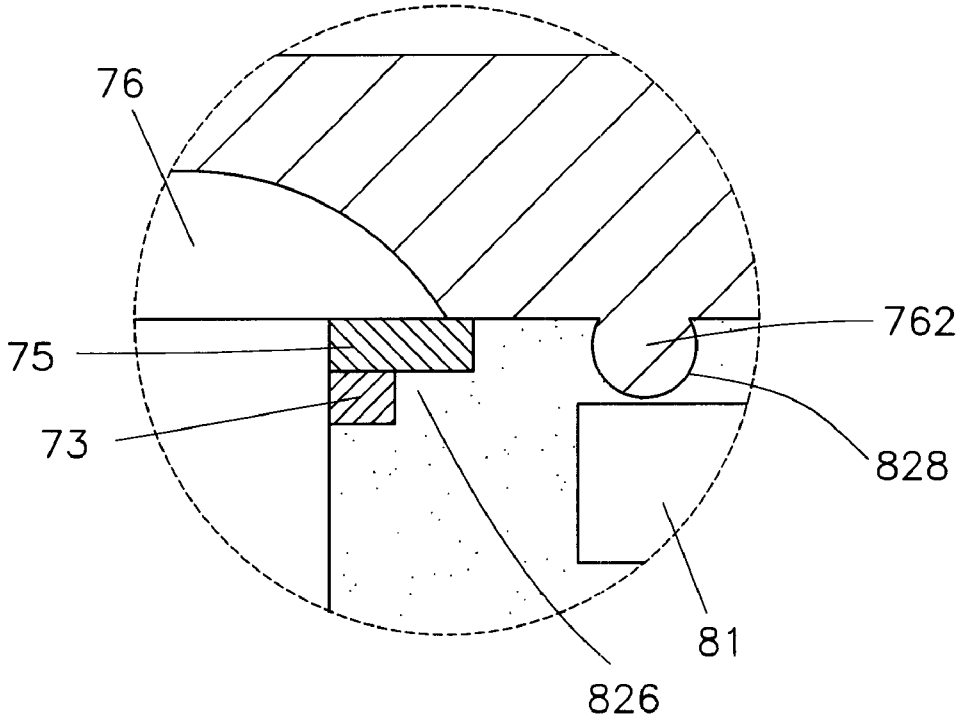
FIG. 9A is a partially cut-away enlarged view of the tubular spring hinge assembly as shown in FIG. 9.

The base portion 82 of the regulator 80 is formed with a recess 824 for receiving the first washer 73 and the second washer 75 as shown in FIG. 9A. The first washer 73 has a periphery formed with multiple insertion openings 732. The recess 824 is provided with multiple protruding insertion teeth 826 inserted into the multiple insertion openings 732, thereby preventing the shaft hole of the regulator 80 from being enlarged by the central shaft 70. The second washer 75 may be used to support the enlarged head 71 during the punching process of the enlarged head 71, thereby preventing the enlarged head 71 from jamming the regulator 80, so as to increase the lifetime of the regulator 80.

Figure 9B:
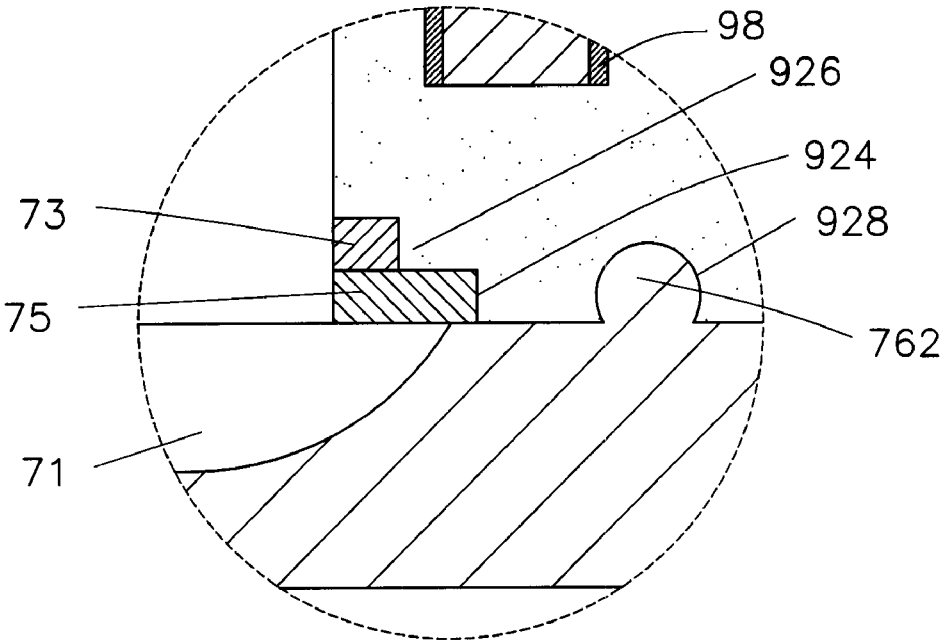
FIG. 9B is a partially cut-away enlarged view of the tubular spring hinge assembly as shown in FIG. 9.

The base portion 92 of the positioner 90 is formed with a recess 924 for receiving the first washer 73 and the second washer 75 as shown in FIG. 9B. The first washer 73 has a periphery formed with multiple insertion openings 732. The recess 924 is provided with multiple protruding insertion teeth 926 inserted into the multiple insertion openings 732, thereby preventing the shaft hole of the positioner 90 from being enlarged by the central shaft 70. The second washer 75 may be used to support the enlarged head 71 during the punching process of the enlarged head 71, thereby preventing the enlarged head 71 from jamming the positioner 90, so as to increase the lifetime of the positioner 90.

A cover 76 is mounted on each of the regulator 80 and the positioner 90 for covering the enlarged head 71 of the central shaft 70. The base portion 82 of the regulator 80 is formed with multiple insertion recesses 828, and the base portion 92 of the positioner 90 is formed with multiple insertion recesses 928. The cover 76 is provided with multiple snapping bosses 762 each inserted and snapped into one of the multiple insertion recesses 828 of the base portion 82 of the regulator 80 and one of the multiple insertion recesses 928 of the base portion 92 of the positioner 90, so that the cover 76 may be secured on the regulator 80 and the positioner 90.

The leaf 62 of the outer tube 60 is provided with a shoulder 622 which is formed with an abutting edge 624, so that the door plate or the door frame may be rested on the abutting edge 624 of the shoulder 622 of the leaf 62 of the outer tube 60, thereby facilitating assembly of the outer tube 60. In addition, the shoulder 622 of the leaf 62 of the outer tube 60 is formed with a recessed resting portion 626 for positioning the pin member 81.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tubular spring hinge assembly, comprising a first outer tube, a second outer tube, a central shaft, a torsion spring, and two regulators, wherein:

the first outer tube has a side provided with a leaf, the second outer tube has a side provided with a leaf, the first outer tube is pivotally mounted on the second outer tube, the torsion spring is mounted in the first outer tube and the second outer tube, each of the two regulators is mounted on an outer end of the first outer tube and the second outer tube respectively, the central shaft is mounted in the torsion spring, and has two ends each extended through each of the two regulators, the torsion spring has two ends each inserted into each of the two regulators, each of the two regulators has a periphery provided with a pin member which is rested on the leaf of each of the first outer tube and the second outer tube; and wherein:

a first separation tube is mounted in a first end of the first outer tube, a second separation tube is mounted in a first end of the second outer tube, the first separation tube has a first end having an outer wall formed with an annular separation flange rested on an end face of the first end of the first outer tube, the second separation tube has a first end having an outer wall formed with an annular separation flange rested on an end face of the first end of the second outer tube, so as to separate the first outer tube from the second outer tube, thereby preventing the first outer tube and the second outer tube from rubbing and producing noise, the first separation tube has a second end having an inner wall formed with an annular retaining portion, the second separation tube has a second end having an inner wall formed with an annular retaining portion, a connecting tube is mounted between the first outer tube and the second outer tube, and is mounted in the first separation tube and the second separation tube, the connecting tube has two ends each retained by the annular retaining portion of the first separation tube and the annular retaining portion of the second separation tube.

2. The tubular spring hinge assembly in accordance with claim 1, further comprising a first separation ring made of a wear-resistant plastic mounted in a second end of the first outer tube, and a second separation ring made of a wear-resistant plastic mounted in a second end of the second outer tube, wherein the first separation ring is formed with an annular separation flange mounted between one of the two regulators and the first outer tube, and the second separation ring is formed with an annular separation flange mounted between the other of the two regulators and the second outer tube, thereby preventing each of the two regulators from contacting and rubbing the first outer tube and the second outer tube, so as to eliminate noise and to increase the lifetime of each of the two regulators.

3. The tubular spring hinge assembly in accordance with claim 1, wherein the torsion spring has a horn shape and has an outer diameter gradually reduced from two ends toward a mediate portion thereof, the connecting tube is mounted on the mediate portion of the torsion spring, an inner diameter of the connecting tube is smaller than a maximum outer diameter of the torsion spring, a wall of the connecting tube is axially formed with a slit, so that the connecting tube may be mounted on the mediate portion of the torsion spring by the slit, and the annular separation flange of each of the first separation tube and the second separation tube has a first end formed with a cavity, and a second end provided with a snap portion that may be snapped and inserted into the cavity, thereby snapping each of the first separation tube and the second separation tube.

4. The tubular spring hinge assembly in accordance with claim 1, wherein the central shaft has two ends each formed with an enlarged head for positioning each of the two regulators.

5. The tubular spring hinge assembly in accordance with claim 4, wherein the enlarged head of each of the two ends of the central shaft is provided with a first washer and a second washer, the second washer is located between the first washer and the enlarged head, and a base portion of each of the two regulators is formed with a recess for receiving the first washer and the second washer.

6. The tubular spring hinge assembly in accordance with claim 5, wherein the first washer has a periphery formed with multiple insertion openings, and the recess is provided with multiple protruding insertion teeth inserted into the multiple insertion openings.

7. The tubular spring hinge assembly in accordance with claim 1, further comprising a cover mounted on each of the two regulators, wherein a base portion of each of the two regulators is formed with multiple insertion recesses, and the cover is provided with multiple snapping bosses each inserted and snapped into one of the multiple insertion recesses of the base portion of each of the two regulators, so that the cover may be secured on each of the two regulators.

8. The tubular spring hinge assembly in accordance with claim 1, wherein the leaf of each of the first outer tube and the second outer tube is provided with a shoulder which is formed with an abutting edge.

9. The tubular spring hinge assembly in accordance with claim 8, wherein the shoulder of the leaf of each of the first outer tube and the second outer tube is formed with a recessed resting portion for positioning the pin member.

10. The tubular spring hinge assembly in accordance with claim 1, wherein an inner wall of the first outer tube is formed with a mounting section for mounting the first separation tube, and an inner wall of the second outer tube is formed with a mounting section for mounting the second separation tube.

11. The tubular spring hinge assembly in accordance with claim 1, wherein each of the two regulators is an axial integrally formed stepped body including a base portion, a positioning portion, and a separation portion, the base portion has an outer diameter greater than that of the positioning portion, the positioning portion has an outer diameter greater than that of the separation portion, the positioning portion is located between the base portion and the separation portion, the separation portion is extended into each of two ends of the torsion spring, for separating the torsion spring from the central shaft, thereby preventing the torsion spring from rubbing the central shaft, and the positioning portion is formed with a positioning hole for mounting a metallic protection tube for insertion of each of the two ends of the torsion spring.

12. A tubular spring hinge assembly, comprising a base, and a pair of pivot structures, wherein, the base includes two main tubes, and a connecting plate mounted between the two main tubes, each of the pivot structures is mounted on one of the two main tubes;

each of the pivot structures includes an outer tube, a central shaft, a torsion spring, a regulator, and a positioner, wherein:

the outer tube has a side provided with a leaf, the outer tube is pivotally mounted on one end of the main tube, the positioner is mounted on the other end of the main tube, the torsion spring is mounted in the outer tube and the main tube, the regulator is mounted on an outer end of the outer tube, the central shaft is mounted in the torsion spring and has two ends each extended through the regulator and the positioner;

the torsion spring has two ends each inserted into the regulator and the positioner respectively, the regulator has a base portion having a periphery provided with a pin member that is rested on the leaf;

a first separation tube is mounted in a first end of the outer tube, and a second separation tube is mounted in a first end of the main tube, the first separation tube has a first end having an outer wall formed with an annular separation flange rested on an end face of the first end of the outer tube, the second separation tube has a first end having an outer wall formed with an annular separation flange rested on an end face of the first end of the main tube, so as to separate the outer tube from the main tube, thereby preventing the outer tube and the main tube from rubbing and producing noise, the first separation tube has a second end having an inner wall formed with an annular retaining portion, the second separation tube has a second end having an inner wall formed with an annular retaining portion, and a connecting tube is mounted in the first separation tube and the second separation tube, and has two ends each retained by the annular retaining portion of the first separation tube and the annular retaining portion of the second separation tube.

13. The tubular spring hinge assembly in accordance with claim 12, further comprising a separation ring mounted in a second end of the outer tube, wherein the regulator is mounted in the separation ring, the separation ring has one end having an outer wall formed with an annular separation flange mounted between the base portion of the regulator and the outer tube, thereby preventing the regulator from contacting and rubbing the outer tube, so as to eliminate noise and to increase the lifetime of the regulator.

14. The tubular spring hinge assembly in accordance with claim 12, wherein the central shaft has two ends each formed with an enlarged head for positioning the regulator and the positioner.

15. The tubular spring hinge assembly in accordance with claim 14, wherein the enlarged head of each of the two ends of the central shaft is provided with a first washer and a second washer, the second washer is located between the first washer and the enlarged head, the base portion of the regulator is formed with a recess for receiving the first washer and the second washer, and a base portion of the positioner is formed with a recess for receiving the first washer and the second washer.

16. The tubular spring hinge assembly in accordance with claim 15, wherein the first washer has a periphery formed with multiple insertion openings, and the recess is provided with multiple protruding insertion teeth inserted into the multiple insertion openings.

17. The tubular spring hinge assembly in accordance with claim 12, further comprising a cover mounted on the regulator and the positioner, wherein each of the regulator and the positioner is formed with multiple insertion recesses, and the cover is provided with multiple snapping bosses each inserted and snapped into one of the multiple insertion recesses, so that the cover may be secured the regulator and the positioner.

18. The tubular spring hinge assembly in accordance with claim 12, wherein the leaf is provided with a shoulder which is formed with an abutting edge.

19. The tubular spring hinge assembly in accordance with claim 18, wherein the shoulder of the leaf is formed with a recessed resting portion for positioning the pin member.

* * * * *